US010302370B2

(12) United States Patent
Maucher et al.

(10) Patent No.: US 10,302,370 B2
(45) Date of Patent: May 28, 2019

(54) HEAT EXCHANGER

(71) Applicant: MAHLE International GmbH, Stuttgart (DE)

(72) Inventors: Ulrich Maucher, Korntal-Münchingen (DE); Jürgen Barwig, Vaihingen/Enz (DE); Steffen Ensminger, Notzingen (DE); Eberhard Pantow, Winnenden (DE); Claudia Lang, Abstatt (DE); Matthias Schmid, Stuttgart (DE); Timo Peifer, Stuttgart (DE); Jürgen Steimer, Esslingen (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 353 days.

(21) Appl. No.: 14/860,851

(22) Filed: Sep. 22, 2015

(65) Prior Publication Data

US 2016/0084205 A1 Mar. 24, 2016

(30) Foreign Application Priority Data

Sep. 22, 2014 (DE) ..... 10 2014 219 056

(51) Int. Cl.
*F28D 7/02* (2006.01)
*F28F 3/00* (2006.01)
(Continued)

(52) U.S. Cl.
CPC ..... *F28F 3/02* (2013.01); *F02M 26/32* (2016.02); *F28D 9/0037* (2013.01);
(Continued)

(58) Field of Classification Search
CPC ..... F28F 3/02; F28F 3/046; F28F 9/0243; F28F 2009/029; F28F 3/005; F28F 3/04;
(Continued)

(56) References Cited

U.S. PATENT DOCUMENTS 2,169,993 A * 8/1939 Booth ..... F28D 9/0037 165/153
2,912,749 A * 11/1959 Huggins ..... B21D 53/04 165/153
(Continued)

FOREIGN PATENT DOCUMENTS

DE 100 24 389 A1 11/2000
DE 10 2005 034 137 A1 1/2007
(Continued)

OTHER PUBLICATIONS

European Search Report, Application No. 15184703.5, dated Feb. 8, 2016, 6 pgs.
(Continued)

*Primary Examiner* — Jason N Thompson
(74) *Attorney, Agent, or Firm* — Paul D. Strain, Esq.; Strain & Strain PLLC

(57) ABSTRACT

The invention relates to a heat exchanger, in particular exhaust-gas cooler or charge-air cooler, comprising a plate stack composed of multiple elongate plate pairs, wherein in each case two interconnected plates form a first fluid duct between them, and a second fluid duct is formed between two plate pairs, wherein the plates of a plate pair are of U-shaped form with a bottom and upturned side walls and lie against one another so as to delimit the first flow duct, wherein one of the plates of a plate pair has, on its end side, a tab which serves for beading over around the end side of the other plate, wherein the tab on the bottom of the plate is beaded over, and the beading-over of the tab also continues into the side walls of the plates.

2 Claims, 6 Drawing Sheets

(51) Int. Cl.

| | |
|---|---|
| ***F28F 3/02*** | (2006.01) |
| ***F28F 3/04*** | (2006.01) |
| ***F28D 9/00*** | (2006.01) |
| ***F28D 21/00*** | (2006.01) |
| ***F02M 26/32*** | (2016.01) |
| ***F28F 9/02*** | (2006.01) |
| *F02B 29/04* | (2006.01) |

(52) U.S. Cl.
CPC ..... *F28D 21/0003* (2013.01); *F28F 3/046* (2013.01); *F28F 9/0243* (2013.01); *F02B 29/0462* (2013.01); *F28D 2021/0082* (2013.01); *F28F 2009/029* (2013.01)

(58) Field of Classification Search
CPC .... F28F 3/048; F28F 3/08; F28F 3/086; F28F 3/10; F28F 2275/12; F28F 2275/122; F28D 9/0243; F28D 9/0037; F28D 9/0031; F28D 1/0308; F02M 25/0737; F02M 26/32; F02B 29/0462
USPC ..... 165/165, 166, 164
See application file for complete search history.

(56) References Cited

U.S. PATENT DOCUMENTS

| | | | | |
|---|---|---|---|---|
| 4,099,928 | A * | 7/1978 | Norback | B21D 22/027 165/166 |
| 4,125,153 | A | 11/1978 | Stoneberg | |
| 4,681,155 | A * | 7/1987 | Kredo | F28D 9/0031 138/163 |
| 5,072,790 | A | 12/1991 | Lapowsky | |
| 2006/0207245 | A1* | 9/2006 | Yamaguchi | F01N 5/02 60/320 |
| 2008/0202735 | A1* | 8/2008 | Geskes | F28D 9/0006 165/166 |
| 2011/0247318 | A1* | 10/2011 | Kuroyanagi | F02M 25/0737 60/278 |
| 2012/0325445 | A1* | 12/2012 | Dinulescu | B21D 51/52 165/166 |
| 2015/0184946 | A1 | 7/2015 | Barwig et al. | |
| 2016/0320139 | A1* | 11/2016 | Nakamura | F28F 9/0221 |

FOREIGN PATENT DOCUMENTS

| | | | |
|---|---|---|---|
| DE | 10 2013 218 444 | A1 | 3/2014 |
| EP | 2 741 042 | A1 | 6/2014 |
| EP | 2 781 870 | A1 | 9/2014 |
| WO | WO 2014/040797 | A1 | 3/2014 |

OTHER PUBLICATIONS

German Search Report, Application No. DE 10 2014 219 056.8, dated Jul. 3, 2015, 8 pgs.

* cited by examiner 61
40
40
8'
18'

10'
18'
40
61
40
10'

7'
7
8
18
7'
10
60
3

10
8
18
90
60
7
10
7' h=H

HEAT EXCHANGER

CROSS-REFERENCE TO RELATED PATENT APPLICATIONS

This application is based upon and claims the benefit of priority from prior German Patent Application No. 10 2014 219 056.8, filed Sep. 22, 2014, the entire contents of which are incorporated herein by reference in their entirety.

TECHNICAL FIELD

The invention relates to a heat exchanger, in particular a charge-air cooler or an exhaust-gas cooler for a motor vehicle, as per the preamble of Claim 1.

PRIOR ART

Exhaust-gas coolers have the task of cooling hot exhaust gas of internal combustion engines in order that said cooled exhaust gas can be admixed to the intake air again. In this case, to increase the thermodynamic efficiency of an internal combustion engine, cooling to a very low level is sought. This principle is generally known as cooled exhaust-gas recirculation, and is used to achieve a reduction of pollutants, such as in particular nitrogen oxides, in the exhaust gas.

DE 100 24 389 A1, DE 10 2005 034 137 A1 and WO 2014/040797 A1 have disclosed such heat exchangers, which are formed from a stack of plate pairs, wherein a first flow duct is formed between a pair of plates, and a second flow duct is formed between two plate pairs stacked one on top of the other.

In this case, the first flow duct is normally closed off to the outside and fluidically connectable to a fluid duct, for the admission of a first fluid into and discharge of a first fluid out of the first flow duct, only via inflow and outflow openings in the stack or on a housing surrounding the stack. In this case, the first fluid is normally a cooling fluid such as, for example, cooling water.

The second flow duct is likewise normally of open form at its narrow side, in order, for example via a provided connector element, for a second fluid to be distributed to or discharged from the multiplicity of second flow ducts which are arranged adjacent to one another in stacked fashion. Here, as second fluid, use is made of a gas such as air, exhaust gas or an exhaust gas-air mixture.

In the case of such heat exchangers, the inflowing second fluid is generally very hot, such that the front edge of the plate pairs at the inflow side at which the second fluid enters the heat exchanger is subject to very high thermal stress.

The temperature transition from the very hot, non-cooled gas inlet region of the second flow duct to that region of the heat exchanger which is connected to the coolant leads to high stresses owing to the different thermal expansion owing to the different temperatures.

Furthermore, in the inlet region for the hot gas, the gas is generally guided using relatively thick-walled diffusers in order to be able to withstand the high pressures and temperatures, wherein the heat-exchanging plates of the heat exchanger are designed with the thinnest walls possible for reasons of efficiency, cost and weight. Owing to the different prevailing temperatures, the diffuser and the plates expand to different extents, resulting in high stresses in the relatively thin-walled plates of the plate stack, in particular in the corners of the plates at the hot-gas inlet.

Normally, the plates or the plate pairs are inserted into a tube sheet of the heat exchanger, which is connected to a housing and/or to the gas inlet diffuser. The tube sheet is normally designed with thicker walls than the plates themselves, such that the risk of failure as a result of thermal stresses in the transition region to the hot diffuser is thereby reduced.

For reasons relating to cost, weight and the manufacturing process, however, it is increasingly sought to dispense with a tube sheet and to realize the sealing of the flow ducts, formed as coolant ducts, between a plate pair by way of suitable shaping of the plates. In WO 2014/040797 A1, the heat exchanger is constructed, without a coolant housing, from substantially U-shaped flow ducts.

This has the effect that a front edge of the plate pairs is not straight; rather, the duct geometry correspondingly has a likewise U-shaped front edge. The ducts are inserted into a diffuser and, in this way, at the sides, a narrow braze gap is realized which leads to a sealed brazed connection of the flow duct. At the remaining front edge, however, there is the risk that the two sheet-metal layers of the two plates of a plate pair, which form the top side and the bottom side of the flow duct, do not bear against one another with an accurate fit, with the resulting possibility of brazing defects and leakages.

To ensure a sealed brazed connection, therefore, the planar front edge of the lower plate of a plate pair is folded, for example beaded over, around the front edge of the upper plate of the plate pair. This furthermore increases the strength of the plate front edge at the beaded-over planar regions of the flow duct, because three material layers are present rather than only two material layers. The beading-over however ends in the corners of the flow ducts, that is to say at the plate corners. This gives rise to a notch at which the thickness of the front edge decreases from three layers or sheet-metal thicknesses to two layers or sheet-metal thicknesses. It has been found that it is however precisely in said corner region that particularly intense tensile stresses arise owing to the heated diffuser, and thermally induced failures of the plate pair, and thus of the heat exchanger, occur owing to the notch effect.

Presentation of the Invention, Problem, Solution, Advantages

It is the object of the invention to provide a heat exchanger which is improved in relation to the prior art and has an increased service life.

This is achieved by means of the features of Claim 1.

An exemplary embodiment of the invention relates to a heat exchanger, in particular exhaust-gas cooler or charge-air cooler, comprising a plate stack composed of multiple elongate plate pairs, wherein in each case two interconnected plates form a first fluid duct between them, and a second fluid duct is formed between two plate pairs, wherein the plate pair is of U-shaped form with a bottom and upturned side walls, and the plates lie against one another so as to delimit the first flow duct, wherein one of the plates of a plate pair has, on the edge in the inflow and/or outflow region for the second fluid, which edge normally lies at the end side of the plate pair and is thus referred to here as end side or front edge, a tab which serves for beading over around the end side of the other plate, characterized in that the tab on the bottom of the plate is beaded over, and the beading-over of the tab also continues into the side walls of the plates. In this way, it is the case in particular in the corners between the base and the side walls of the plate pair that a reinforcement is realized, which increases the durability of the heat exchanger. In this case, the base is substantially the bottom of a plate or of a plate pair. The end side may in this case also be referred to as narrow side.

Here, it may be advantageous if the beading-over is performed on the side walls only up to a height which corresponds to only a part of the total height of the side wall.

According to the invention, it is expedient if the plate has a wall thickness, and the height corresponds at least to the wall thickness of the plate, preferably to between 3 and 5 wall thicknesses or greater. In this way, the corner region is advantageously reinforced, wherein a beading-over of the tab in the case of a reduced height is facilitated.

Alternatively, the beading-over on the side walls may extend up to the total height of the side wall.

It is particularly advantageous if the beading-over on the base is performed over the entire width of the base. This advantageously reinforces the narrow side of the plate pair over its entire width which is exposed to the hot fluid flow.

It is also advantageous if the beading-over on the base is only partially performed over the entire width of the base. In this way, the beading-over can be simplified, and weight can be saved.

Further advantageous refinements are described in the following description of the figures and by the subclaims.

BRIEF DESCRIPTION OF THE DRAWINGS

Below, the invention will be discussed in more detail on the basis of at least one exemplary embodiment and with reference to the drawings. In the drawings.

PREFERRED EMBODIMENT OF THE INVENTION

Figure 1:
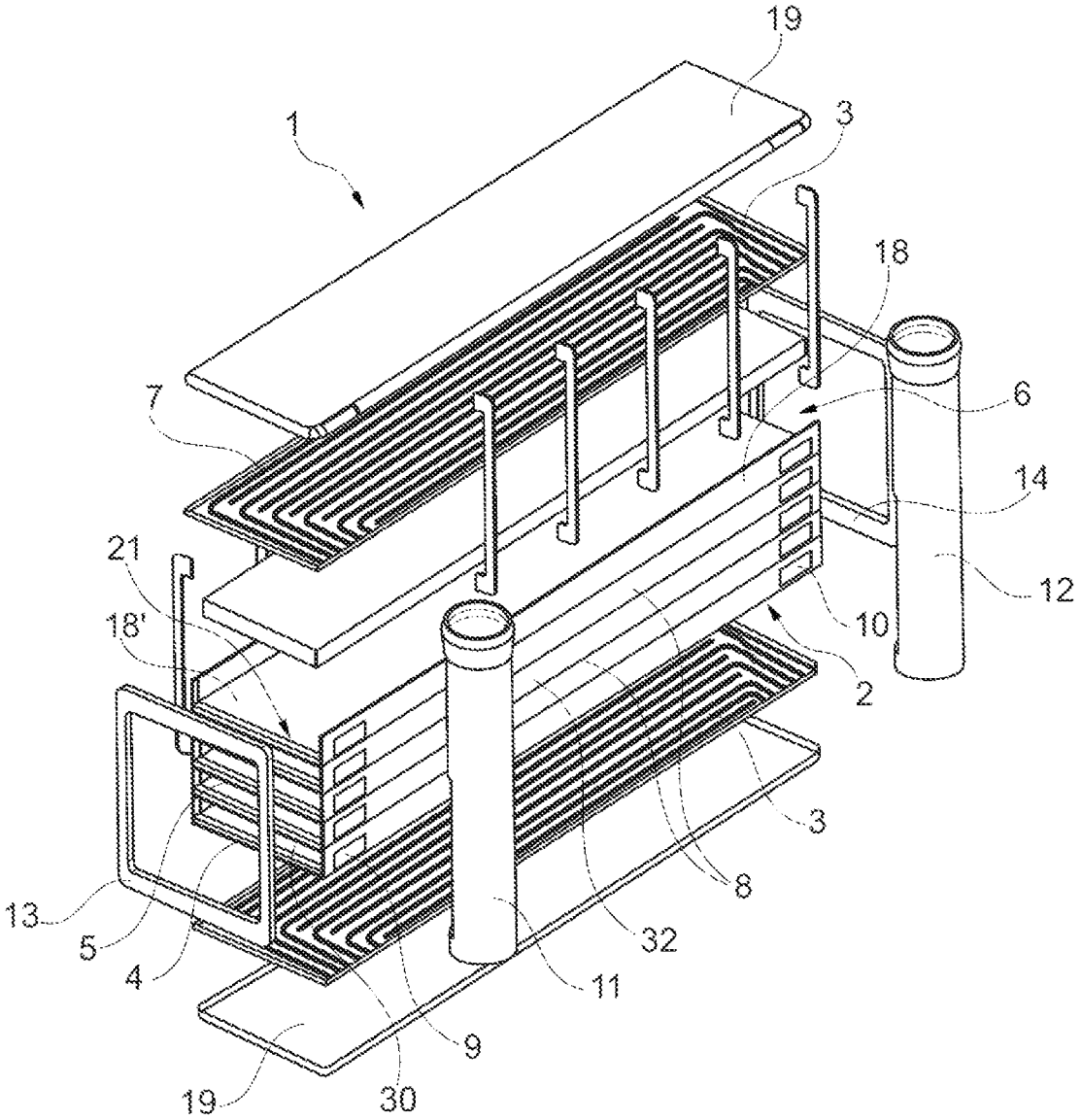
FIG. 1 shows a schematic view of a heat exchanger according to the invention.

FIG. 1 is an illustration of a heat exchanger 1 according to the invention, which is in the form of an exhaust-gas cooler or a charge-air cooler. The heat exchanger 1 may alternatively also be used for other purposes. It is advantageous if a gaseous fluid is used as a second fluid. In this case, as a second, gaseous fluid, use may be made of exhaust gas, air, such as charge air, or an exhaust gas-air mixture. It is also advantageous if a liquid fluid is used as first fluid. For this purpose, water or a water-based mixture may be used as coolant, or some other coolant or a refrigerant may be used. Furthermore, the first fluid may for example be oil, for example in an oil cooler or heater for preheating of the oil upon a cold start.

A heat exchanger 1 of said type may advantageously be used as an exhaust-gas heat exchanger in a motor vehicle. Here, in a so-called exhaust-gas recirculation system (EGR system), exhaust gas discharged from the internal combustion engine of the motor vehicle can be at least partially cooled in the heat exchanger by a liquid coolant of a coolant circuit and supplied to the intake tract of the internal combustion engine again. A heat exchanger 1 of said type may likewise advantageously be used as a charge-air cooler in a motor vehicle. In this case, the charge air is cooled by way of coolant.

The heat exchanger 1 is composed of a stack 2 of elongate plate pairs 32, wherein in each case two plates 18, 18' lying one on top of the other are, along their longitudinal extent, brazed together at their edge in the longitudinal direction.

In this case, the longitudinal direction or the longitudinal side defines the direction or side between two openings as inlet 5 and outlet 6 for a second fluid, said openings being formed at the narrow sides 21, also referred to as end sides. It is nevertheless possible for the extent in the longitudinal direction to be longer, equal to or shorter than the extent of the narrow side.

If the plate pairs 32 formed from the plates 18, 18' are stacked one on top of the other, a second fluid duct 30 is formed between the respective plate pairs 32. In this case, the second fluid duct 30 is formed between an upper plate 18' of a lower plate pair 32 and the lower plate 18 of an upper plate pair 32. Here, a first fluid duct 4 is formed between the two plates 18, 18' of a plate pair 32. The second fluid duct 30 serves for the throughflow of the gaseous second fluid, wherein the first fluid duct 4 serves for the throughflow of the first, liquid fluid.

At the narrow side 21, the plate assembly composed of the two plates 18, 18' is designed to be open, whereby an inlet 5 and an outlet 6 for the second fluid of the second fluid duct are formed. In this case, the two plates are connected at the narrow sides such that the first fluid duct between the two plates 18, 18' is closed off by way of a brazed connection.

The plate pair of the plates 18, 18' has an approximately U-shaped contour with a rectangular outer shape, wherein the plates 18, 18' are brazed together at two longitudinal edges and/or at two longitudinal sides, wherein, in the brazed state, the plates are spaced apart from one another in a central region.

In the interior of each plate pair 32 of the plates 18, 18' there may be integrated a coolant-guiding arrangement 3 which is formed or lies areally on the bottom or the base of the lower plate 18. This may alternatively also be omitted. Said coolant-guiding arrangement 3 may in this case be stamped in the form of a stamped formation or stamped formations into the base 60 of the plate 18 and/or into the base 61 of the plate 18', such that the fluid flowing through the fluid duct 4 formed in the interior of the plate pair 18, 18' is guided and, if appropriate, channeled. For this purpose, it is for example the case that web-like stamped formations are provided which project into the second fluid duct 4 between the two plates 18, 18'. It is alternatively also possible for the coolant-guiding arrangement 3, as a separate component which has the stamped formations or structures, to be arranged between the plates 18, 18'. Here, the base 60, 61 of the plate 18 or 18', respectively, is defined as being the substantially planar or flat region between upturned edges, which may be provided, of a plate 18, 18'.

The second fluid duct 30 is arranged between an upper plate 18' of one plate pair 32 and an adjacent plate 18 of another, adjacent plate pair 32. Exhaust gas or charge air, for example, as second fluid, flows through said fluid duct 30. In this case, the first fluid duct 4 is arranged between the two plates 18, 18' of a plate pair 32. A liquid coolant, for example, flows through said fluid duct 4.

The second fluid, for example exhaust gas, is supplied to the second fluid ducts 30, via the inlet 5 of the plate stack 2, which is formed by an open end of the narrow sides sections 21 of the plate pairs 32 of the plates 18, 18'. The second fluid flows through the second fluid duct 30 and exits the plate stack 2 of the plate pairs 32 with the plates 18, 18' via the outlet 6, which is formed opposite the inlet 5.

The coolant duct arrangement 3 has multiple coolant-guiding webs 7 which run parallel to one another in the longitudinal direction of the plates 18 and which form individual sub-ducts, the open ends of which close to the inlet 5 and to the outlet 6 respectively for the second fluid are guided so as to run in a direction perpendicular to the inlet 5 and to the outlet 6 respectively. Said webs lead the sub-ducts, arranged between them, to the inlet and outlet, respectively, for the first fluid, said inlet and outlet being in the form of openings 9, 10 in the side walls or edges 8 of the plate 18.

Each plate 18 has, on both sides in its longitudinal extent, an upturned edge 8 in the form of a fold which extends vertically in the direction of the adjacent plate 18, of identical form, situated thereabove.

The plate 18' likewise has, on both sides, a respective upturned edge 40 which is bent upwards in the manner of a fold, with said fold being bent downwards again laterally at the outside. In this way, the edge 40 is, as it were, of double-layer form, with a spacing being provided between the two layers. The plate 18' lies on the plate 18, and the edges 40 lie between the edges 8. In this case, it is advantageously the case that the outer walls of the edges 40 and 8, respectively, are in contact.

Depending on the required cooling power, it is possible for a multiplicity of such connected plate pairs 32 with the plates 18, 18' to be stacked one on top of the other as a plate stack 2.

In the longitudinal direction of the plate pairs 32, in the end region of the respectively brought-together ends of the plates 18, 18', in each case one opening 9 and 10, respectively, is formed in the edge 8 of the plate 18. Said openings 9, 10 serve for the discharge and admission, respectively, of the first fluid, such as coolant. The openings of the respective plate pairs are arranged so as to lie one above the other in the plate stack 2. The openings 9 and 10, situated one above the other, of multiple plate pairs 32 of the plates 18, 18' are completely covered, and fluidically connected, by in each case one coolant manifold duct 11, 12. In this case, the respective coolant manifold duct 11, 12 may have a recess (not illustrated in any more detail) which sealingly covers the openings 9 and 10 respectively. In this case, the coolant manifold duct 11, 12 is advantageously in the form of a deep-drawn part or tubular segment and is pushed over the openings 9 or 10 of the plates 18.

At the narrow side 21, the plate stack 2 is bordered in each case by a frame 13, 14. Furthermore, at the narrow sides 21 of the plate stack 2, the plates 18 are shaped such that, without or optionally together with the frame 13, 14, a continuously encircling contour is realized over which in each case a diffuser, a flange or an adapter can be mounted and brazed in leakage-free fashion.

The heat exchanger 1 terminates, at the top side, with a rimless or rimmed cover plate 19. Said cover plate 19 can be placed onto or between the edge 8 or between the edges of the uppermost plate 18 or of both plates 18, 18'. By means of the cover plate 19, the uppermost fluid duct 30, which is in particular a coolant duct, is closed off, without the need for additional components.

At the bottom side, a likewise rimless base plate serves to stabilize the final lower plate 18.

The first fluid duct 4 between the two plates 18, 18' is of approximately U-shaped form. In this case, the fluid duct 4 occupies a first sub-region which is, in effect, of planar form and which runs substantially parallel to the bottom 60 of the plate 18. Furthermore, the fluid duct 30 occupies two lateral sub-regions which are oriented substantially perpendicular to the plane of the bottom 60 of the plate 18. In this case, the sub-regions are designed such that the fluid duct 30 is taller at the edges than in the central sub-region of the bottom 60 of the plate 18.

If said plate pair 32 designed in this way has a further, identical plate pair 32 placed thereon, the lower plate 18 of the upper plate pair 32 closes off the second fluid duct 30 between the lower and the upper plate pairs 32 by lying on the edges 8 of the lower plates 18 and/or of the upper plate 18' of the lower plate pair 32.

Figures 2, 3, 4, 5:
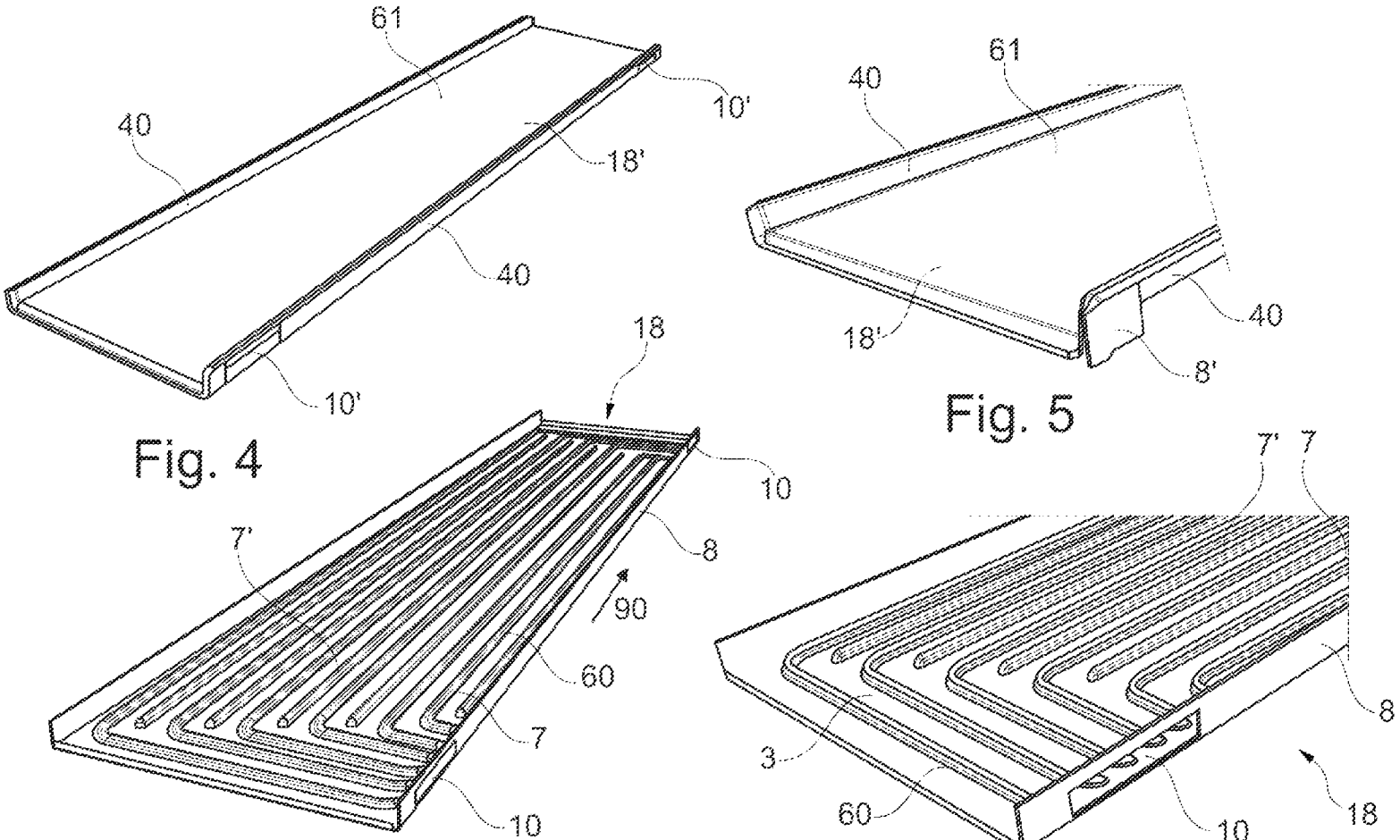
FIG. 2 shows an overall view of the lower plate of the plate pair.
FIG. 3 is a detailed illustration of the lower plate of the plate pair.
FIG. 4 shows an overall view of the upper plate of the plate pair.
FIG. 5 is a detailed illustration of the upper plate of the plate pair.

FIGS. 2 and 3 show a lower plate 18 of the plate pair. In this case, the plate has an approximately rectangular elongate contour. At the two opposite lateral sides of the plate 18, an edge 8 is bent upward, said edge projecting upward substantially at right angles from the bottom or base or from the plane of the bottom or base 60. At the ends, or adjacent to the ends, of the plate, openings 10 for the inflow and outflow of a fluid are formed in one edge 8. In this case, the openings 10 are of substantially rectangular form.

Webs 7 as a coolant guiding arrangement 3 are stamped into the base 60, which webs serve to form sub-ducts and form a flow path between the openings 10. In this case, some of the webs 7, or the webs 7, are shaped so as to have a rectangular profile from one opening 10 to the other opening 10. In a first section, said webs run perpendicular to the main orientation 90 of the plate 18; in a middle section, said webs run parallel to the main orientation 90 of the plate 18; and in a further section, said webs again run perpendicular to the main orientation 90 of the plate 18.

Between the webs 7 formed in this way, it is also possible for there to be arranged second webs 7' which have only an orientation parallel to the main orientation 90.

FIGS. 4 and 5 show an upper plate 18' of the plate pair. In this case, the plate 18' has an approximately rectangular elongate contour. At the two opposite lateral sides of the plate 18, an edge 8 is bent upward, said edge projecting upward substantially at right angles from the bottom or from the plane of the bottom 61. In this case, the edge 8' is of double-walled form. At the ends, or adjacent to the ends, of the plate 18', openings 10' for the inflow and outflow of a fluid are formed in the outer edge metal sheet of the edge 8'. In this case, the openings 10' are of substantially rectangular form.

The base 61 is of planar form, or may have webs or other stamped formations which extend downward into the first fluid duct.

At the front end region and at the rear end region of the plate 18', both the base and the edges are stamped such that, when the plate 18' is placed onto the plate 18, a sealed end region is realized.

When the plate 18' is placed onto the plate 18, the first fluid duct 4 is formed between the two plates 18, 18'. The two plates 18, 18' are sealingly connected to one another, aside from the openings 10.

Figure 6:
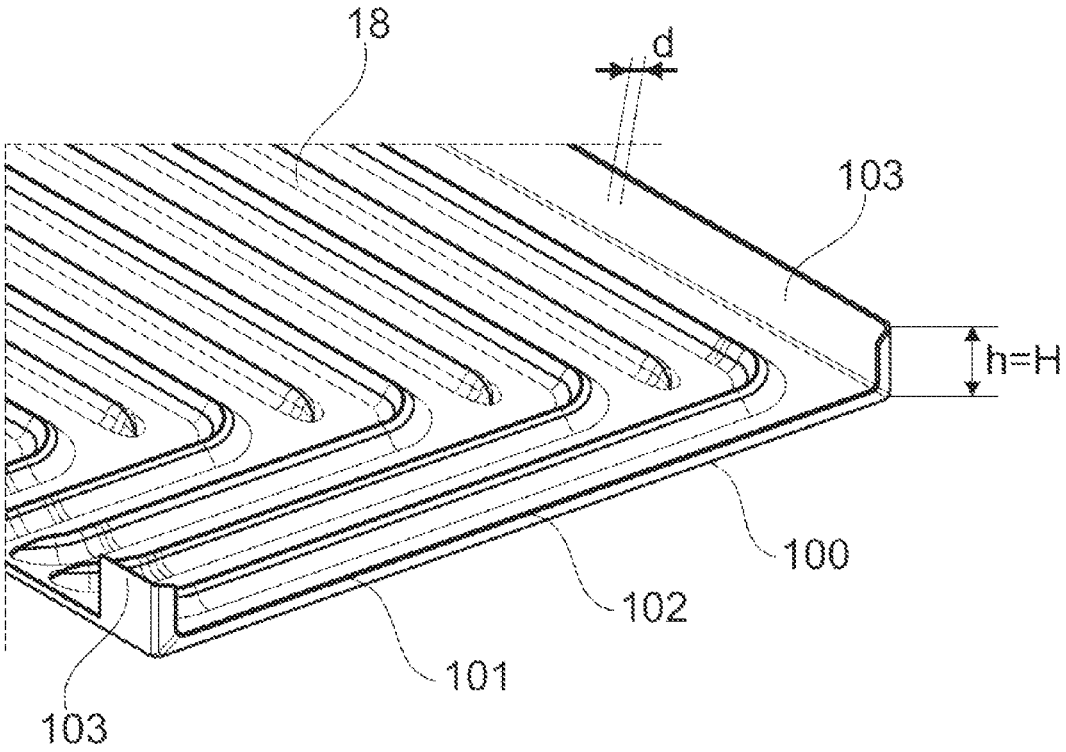
FIG. 6 is a detailed illustration of a plate of the heat exchanger according to the invention.

FIG. 6 shows a lower plate 18 which, at its narrow side 100 which is situated to the fore, is formed such that a U-shaped encircling tab 101 projects from the bottom 102 and from the side walls 103, which tab, after the second plate of the plate pair has been placed on, is beaded over in the U-shaped region of the bottom 102 and of the side walls 103, also referred to as edges.

Figure 7:
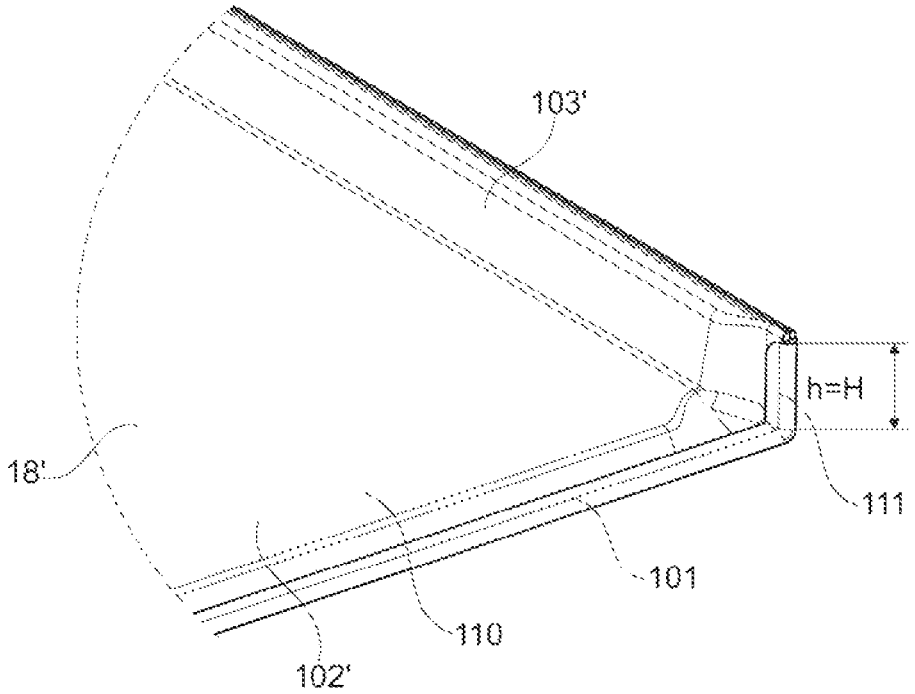
FIG. 7 is a detailed illustration of a plate of the heat exchanger according to the invention.
Figure 8:
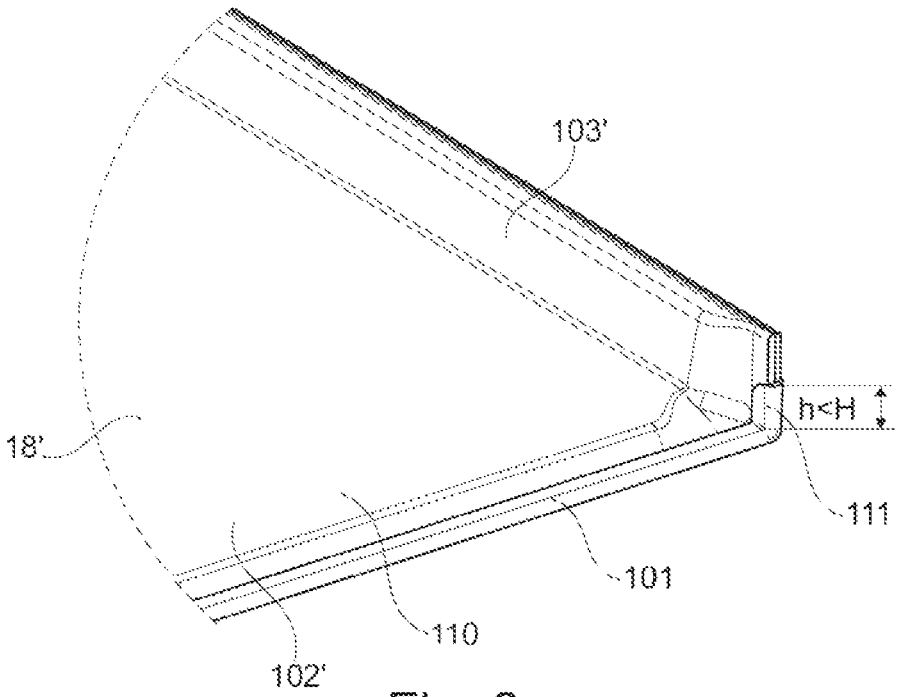
FIG. 8 is a detailed illustration of a plate of the heat exchanger according to the invention.

FIGS. 7 and 8 each show a plate pair 110, in which a plate 18' has been placed onto a lower plate 18, wherein the tab 101 of the lower plate 18 both on the base 102 and on the side walls 103 has been beaded over the base 102' and the side walls 103' of the plate 18'. This gives rise to the dashed line 111 as the edge of the bent-over tab 101.

The beading-over at the front edge is performed, proceeding from the base, across the corners and into the side wall. It is preferable for the entire U-shaped front edge to be completely beaded over. For manufacturing reasons, it may however be expedient for the beading-over to be performed not over the entire lateral height of the side wall, such as is shown in FIG. 8. By contrast, FIG. 7 is an illustration in which the beading-over has been performed over the full height of the sides.

In this case, it is advantageous for the beading-over to be continued over the region which is brazed to the frame or diffuser, at least over one wall thickness of the plate in height, in order firstly to benefit from the increased material thickness and secondly to relocate the region with a notch into a less critical region of the side wall. An overlap region with a height of at least approximately three to approximately five plate wall thicknesses is advantageously realized as a result of beading-over.

Figure 9:
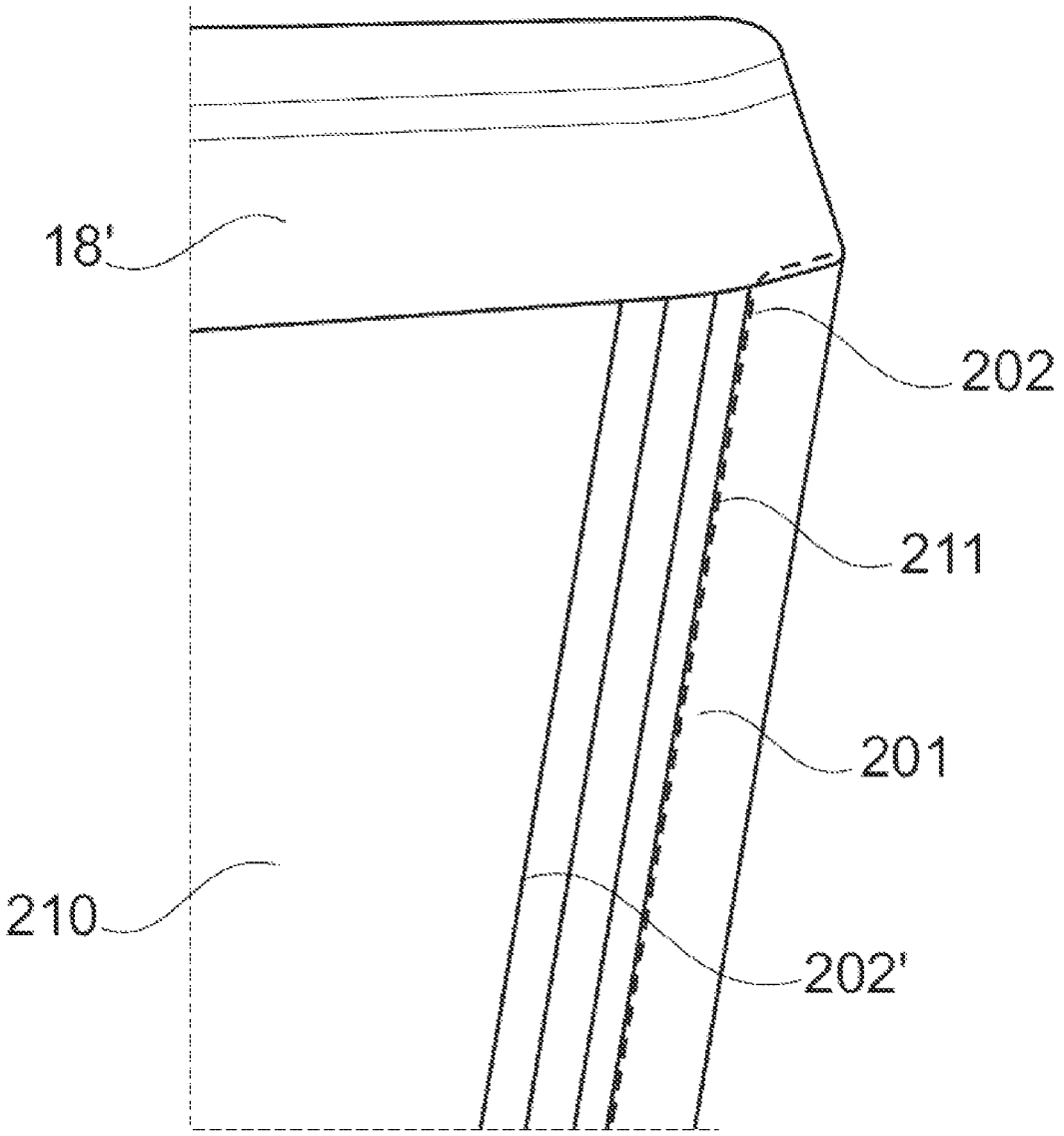
FIG. 9 is a detailed illustration of a plate according to the prior art.
Figure 10:
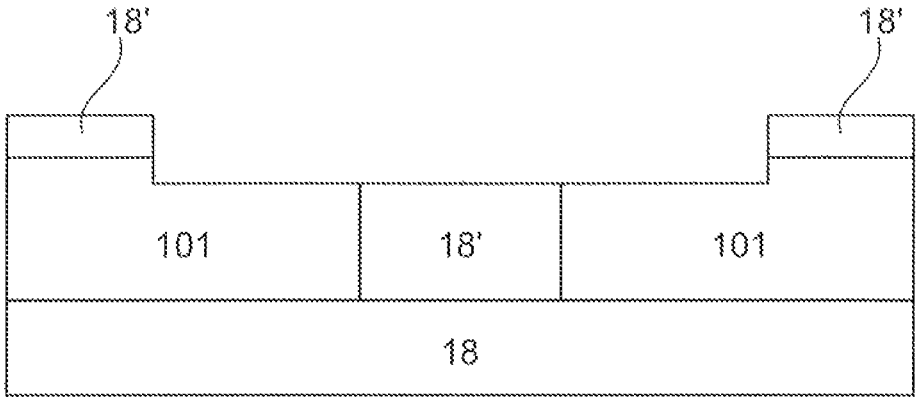
FIG. 10 is a block diagram depicting another embodiment of the present subject matter, in which the beading-over on the base is only partially performed over the entire width of the base.

FIG. 9 shows a plate pair 210 according to the prior art, in which a plate 18' has been placed onto a lower plate 18, wherein the tab 201 of the lower plate 18 has been beaded, only at the base 202, over the base 202' of the plate 18'. This gives rise to the dashed line 211 as the edge of the bent-over tab 201. It can be seen that the beaded-over tab 201 ends precisely in the corner between the base and side wall, which leads to a considerable notch effect and to a greater risk of failure.

The invention claimed is:

1. A heat exchanger comprising a plate stack having a plurality of elongate plate pairs of interconnected plates, wherein each of the elongate plate pairs of interconnected plates bounds a first fluid duct arranged between interconnected plates of the elongate plate pairs of interconnected plates, wherein a second fluid duct is formed between two adjacent elongate plate pairs of the elongate plate pairs of interconnected plates, wherein the interconnected plates of each of the elongate plate pairs of interconnected plates r comprise a first plate and a second plate, wherein in each of the elongate plate pairs of interconnected plates:

(a) the first plate and the second plate are both of U-shaped form having a bottom and upturned side walls, (b) the first plate and the second plate lie against one another so as to delimit the first flow duct, (c) the first plate has, on an end side, a tab which is bent over and around the bottom and the upturned side walls of the second plate in a region adjacent to an end side of the second plate, wherein the tab is bent over the side walls of the second plate only up to a height which corresponds to only a part of a total height of the side walls of the second plate.

2. The heat exchanger according to claim 1, wherein in each of the elongate plate pairs of interconnected plates:

(d) the first plate and the second plate each have a wall thickness, wherein a height of the first plate and the second plate is 3 to 5 times the wall thickness.

* * * * *